United States Patent [19]

Volkert

[11] Patent Number: 4,874,356

[45] Date of Patent: Oct. 17, 1989

[54] METHOD OF MAKING A PIECE CONTAINING MULTIPLE POP-UPS

[75] Inventor: John K. Volkert, Northfield, Ill.

[73] Assignee: One Up, Inc., Northfield, Ill.

[21] Appl. No.: 72,338

[22] Filed: Jul. 10, 1987

[51] Int. Cl.[4] ..... B05C 1/00

[52] U.S. Cl. ..... 493/335; 493/346; 493/381; 493/334; 493/344; 493/955; 40/124.1; 40/530; 428/12; 428/13

[58] Field of Search ..... 493/334, 344, 356, 379, 493/955, 959, 335, 346, 381; 40/124.1, 530, 539; 428/9, 12, 13; 446/148

[56] References Cited

U.S. PATENT DOCUMENTS

| | | | |
|---|---|---|---|
| 2,152,299 | 12/1938 | Arndt | 40/126 |
| 2,544,783 | 3/1951 | Freedman et al. | 40/126 |
| 2,742,723 | 4/1956 | Klein et al. | 40/126 |
| 3,995,388 | 12/1976 | Penick et al. | 40/126 A |
| 4,337,589 | 7/1982 | Volkert et al. | 40/124.1 |
| 4,349,973 | 9/1982 | Penick et al. | 40/124.1 |
| 4,657,612 | 4/1987 | Schoenleber et al. | 446/148 |

*Primary Examiner*—Frederick R. Schmidt

*Assistant Examiner*—Robert Showalter

*Attorney, Agent, or Firm*—Fitch, Even, Tabin & Flannery

[57] ABSTRACT

An improved method for making promotional pieces wherein a high speed web-press operation results in mass-production of attractive pieces which include three or more interconnected pop-up panels which assume a three-dimensional shape when the outer folder is opened. The preferred method utilizes a plurality of longitudinal slitting and folding steps, together with the application of glue lines in strategic locations, and culminates in the transverse cutting of the continuous moving web to separate each blank in series from the next. A continuous web is preferably longitudinally slit into at least three continuous ribbons which are then manipulated and associated with one another to create an endless series of interconnected pop-up assemblies atop a ribbon consisting of two side-by-side basepieces. In an alternative method, only two ribbons are employed, and pieces having a false backbone are created. After final folding in half, the web is compressed, trimmed and transversely cut into individual, identical promotional pieces.

18 Claims, 3 Drawing Sheets

FIG 8
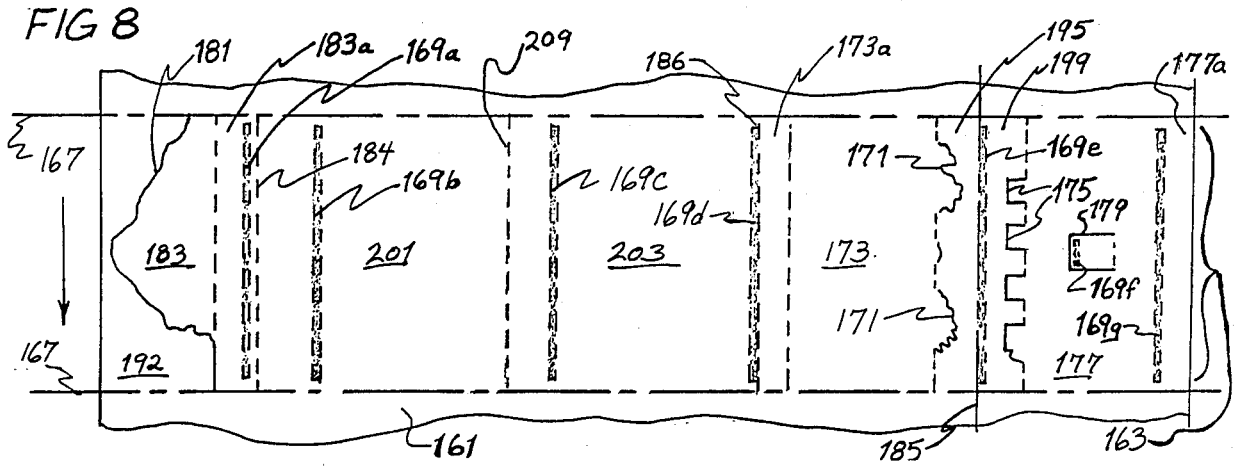
FIG 9A
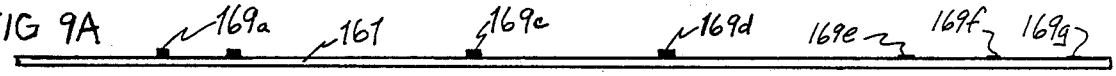
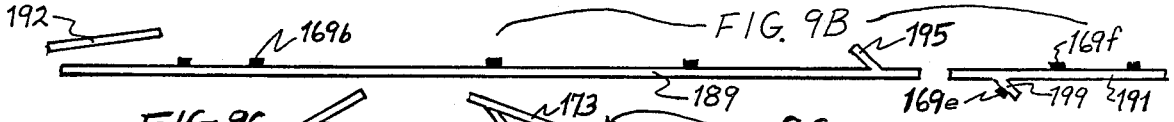
FIG 9C
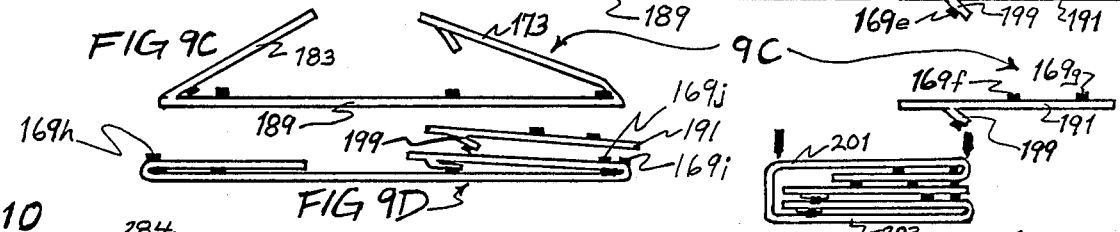
FIG 9D
FIG 10
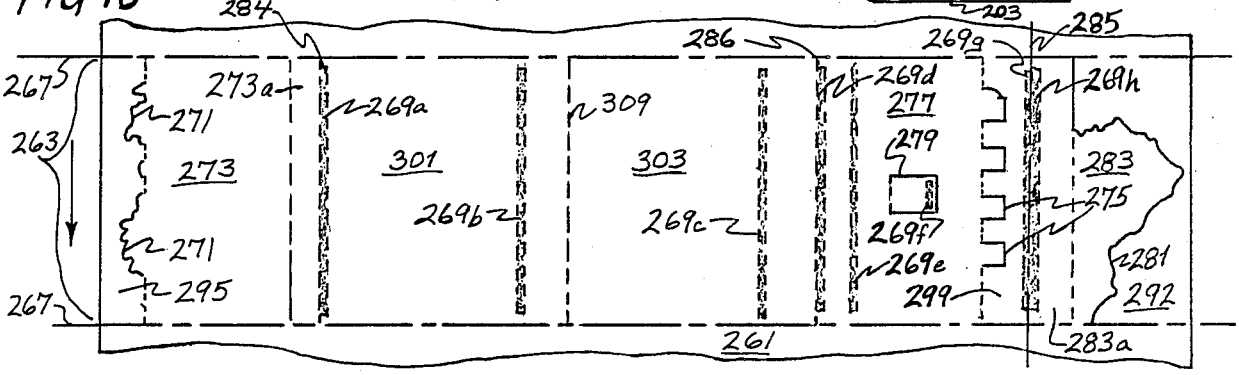
FIG. 11A
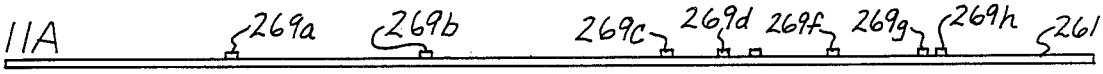
FIG 11B
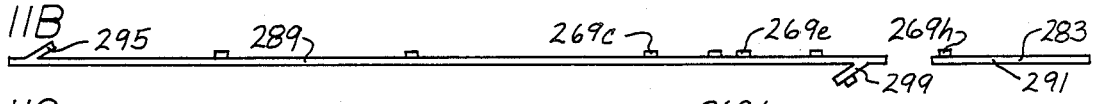
FIG 11C
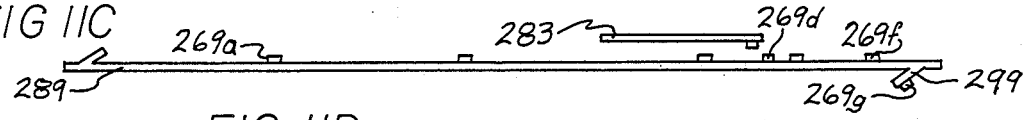
FIG 11D
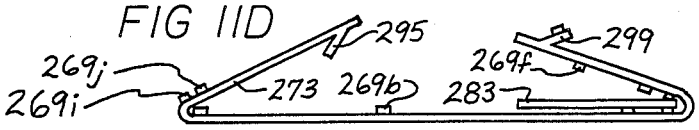
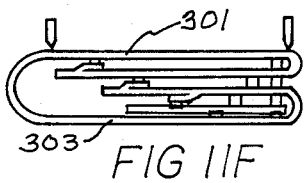
FIG 11F
FIG 11E
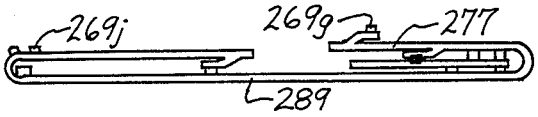

METHOD OF MAKING A PIECE CONTAINING MULTIPLE POP-UPS

This invention relates to the making of printed promotional pieces and more particularly to methods of making such promotional items having multiple, interconnected pop-ups on a web printing press. More specifically, it is directed to the mass-production creation, on a web printing press, of promotional or advertising pieces or the like wherein multiple interconnected pop-ups are positioned between the facing pages of a pair of basepieces that form a folder so that, upon opening of the folder, dimensional pop-ups move upward and out from the planes of the basepiece panels.

U.S. Pat. No. 3,995,388, issued Dec. 7, 1976, discloses methods for making pop-up paper promotional pieces having significant advantages over hand-assembly methods generally theretofore employed for producing such products. U.S. Pat. Nos. 4,337,589 and 4,349,973 disclose more specialized mass-production methods for making promotional pieces which include dimensional pop-ups, which methods are well-suited for economical mass-production, particularly as part of a web-press operation.

Improvements in such mass-production methods of making promotional pieces or the like are continually being sought.

SUMMARY OF THE INVENTION

The present invention provides an improved method for making a promotional piece or the like using a high speed web-press operation which results in the mass-production of pieces which are particularly attractive because they include two or three or more interconnected pop-up panels which assume a three-dimensional shape creating maximum in-depth dimension when the two basepiece panels, that constitute the outer folder, are opened from their flat-folded condition. The method utilizes a plurality of longitudinal slitting and folding steps, together with the application of glue lines in strategic locations, and culminates in the transverse cutting of the continuous moving web to separate each blank in series from the next and thereby economically mass-produce identical promotional pieces of a desired design. Very generally, the method longitudinally slits a continuous web into at least two continuous ribbons which are then manipulated and associated with one another to create an endless series of flat-folded assemblies that are ultimately transversely cut into individual, identical promotional pieces.

BRIEF DESCRIPTION OF THE DRAWINGS

FIG. 8 is a view similar to FIG. 1 of still another alternative embodiment of a continuous web that may be employed to produce a promotional piece substantially the same as that depicted in FIG. 3;

FIGS. 9A–9E are a series of diagrammatic views similar to FIGS. 2A–2F showing one method of handling the continuous web depicted in FIG. 8 to produce promotional pieces;

FIG. 10 is a view similar to FIG. 1 of yet another alternative embodiment of a continuous web that may be employed to produce a promotional piece substantially the same as that depicted in FIG. 3; and FIGS. 11A–11F are a series of diagrammatic views similar to FIGS. 2A–2F showing one method of handling the continuous web depicted in FIG. 10.

DETAILED DESCRIPTION OF THE PREFERRED EMBODIMENTS

Figure 1:
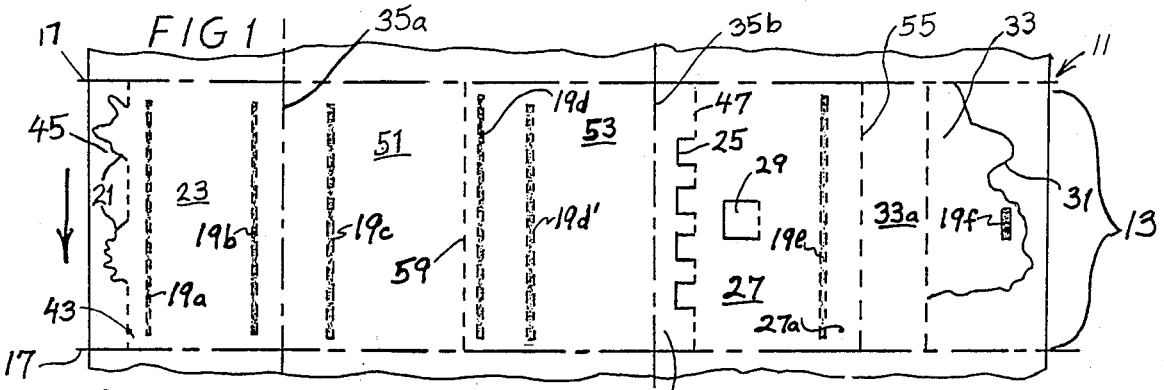
FIG. 1 is a section of a continuous printed web which has been die-cut to define portions of pop-up panels and to which a plurality of glue lines have been applied.
Figure 3:
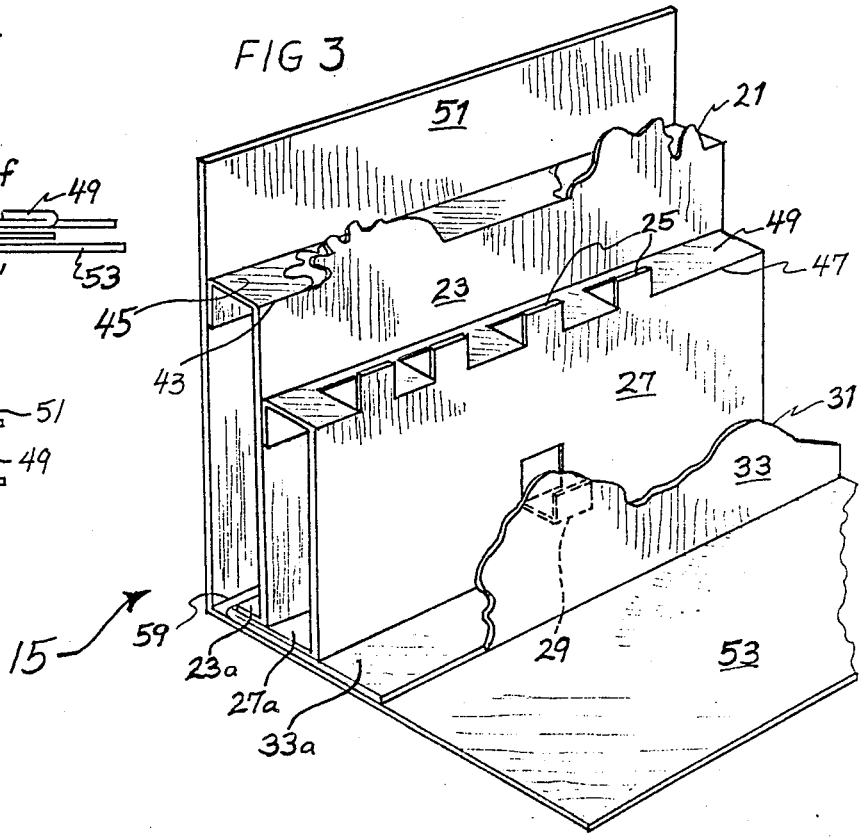
FIG. 3 is a perspective view, enlarged in size, showing the promotional piece which results from the production method depicted in FIGS. 2A–2F.

FIG. 1 shows the region of a continuous web 11, as it might be running on a web printing press, on which is depicted a single, printed blank 13 that has been appropriately die-cut and will eventually form a promotional piece 15 as depicted in FIG. 3. The blank 13 is demarcated for purposes of illustration by a pair of dot-dash lines 17 which extend transversely to the direction of movement of the web, which is shown by the arrow. Also shown in FIG. 1 are a plurality of dotted lines which indicate boundaries between different sections of each blank 13 and which extend in a direction parallel to the longitudinal movement of the web. These dotted lines may be actually formed as lines of weakness in the blank, as for example by pressing or slightly perforating as a part of the die-cutting operation; alternatively, they may be omitted and left to be formed as a result of a subsequent folding operation. It is also satisfactory to simply rely upon the natural resiliency of the paper to effect appropriate bending as a result of an adjacent line of adhesive without a sharp line of demarcation.

The same die-cutting and adhesive application steps are effected to each of the successive blanks 13 of the continuous, sheet material web, which is preferably made of a suitable paper or paperboard material, glossy or matte finish as desired, but which might possibly be an appropriate plastic sheet material. As a part of the adhesive application step, a plurality of glue lines 19 which generally extend longitudinally of the web are preferably applied to the upper surface of the web, as illustrated in FIG. 1. If desired, one or more of such glue lines could be applied to the undersurface of web, or they could be applied at a later stage during the fabrication process. Although these are commonly referred to in the trade as glue lines, any suitable adhesive can be used in the fabrication process, such as a hot-melt or a solvent-based adhesive. Moreover, a heat-activated or an ultrasonic-activated adhesive might instead be applied, either before or after die-cutting, as by printing onto the continuous web, and in such an instance, the adhesive character of the printed glue line 19 may be sequentially activated, if desired, to effect specific attachment between specific parts by subjecting one or more of the glue lines to heat or ultrasonic energy, as appropriate, to activate such previously-applied adhesive patterns. Alternatively, a final activation step could be carried out to finalize attachment at all of the glue lines. Although all of the glue lines are shown, for ease of illustration in FIG. 1, as having been applied to the web either before or after the die-cutting operation and before further manipulation takes place, this is optional, and there is no reason why one or more of the glue lines 19 could not be applied at a later stage of the fabrication process after the web has been slit into multiple ribbons and, for example, after one or more folding steps has occurred.

Figure 2A:
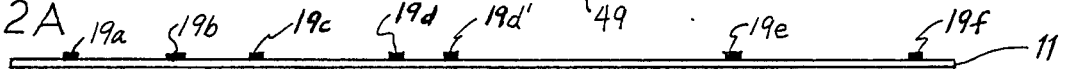
FIGS. 2A–2F are a series of diagrammatic views illustrating a single blank in the web depicted in FIG. 1 and showing the folding and other manipulating steps to which the continuous web is subjected as a part of the overall mass-production method, with FIGS. 2E and 2F being enlarged in size.

More specifically, in the embodiment shown in FIG. 1, the die-cutting operation creates a first die-cut 21 which forms the upper decorative edge of what constitutes the rear pop-up panel 23 in the ultimate promotional piece 15. In addition, another series of die-cuts 25 is effected which, in turn, form the upper decorative edge of an intermediate pop-up panel 27 in the final promotional piece. A tab 29 is also die-cut in the panel 27 for a purpose to be explained hereinafter. The final illustrated die-cut 31 is created to constitute the upper edge of a panel 33 that forms the front pop-up in the ultimate promotional piece. The glue lines 19 are shown in FIG. 1 and are exaggerated in FIG. 2A, which constitutes a view looking at the edge of the strip simply for purpose of illustration. Likewise, the glue lines are shown in solid black so that they will better stand out in the diagrammatical illustrations which constitute FIGS. 2A through 2F. For convenience of illustration, the glue lines are numbered as **19*a* through 19*f* from left to right in FIG. 1**.

Figure 2B:
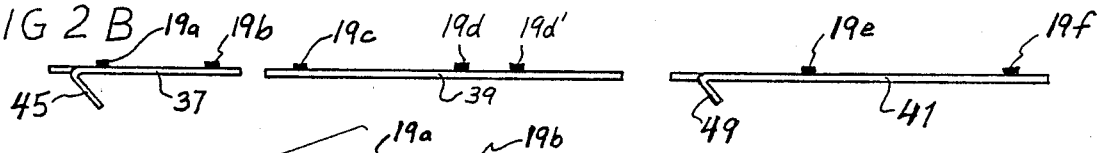

The integral web is then slit longitudinally to form three ribbons using conventional slitting techniques and cutting along the dot-dash lines **35*a* and 35*b* as shown in FIG. 1. As depicted in FIG. 2B, the slitting operation creates a left hand ribbon 37, a center ribbon 39 and a right hand ribbon 41. Following slitting, a portion of the left hand ribbon 37 is folded under the main body of the ribbon along the dotted line 43 which becomes a line of hinged connection between the rear pop-up panel 23 and a connector subpanel 45. Simultaneously or sequentially, as desired, a similar folding operation is carried out along the left hand edge of the ribbon 41 which creates a fold along the dotted line 47 in FIG. 1 which lies generally along the upper edge of the intermediate pop-up panel 27 and likewise forms a connector subpanel 49**.

Figure 2C:
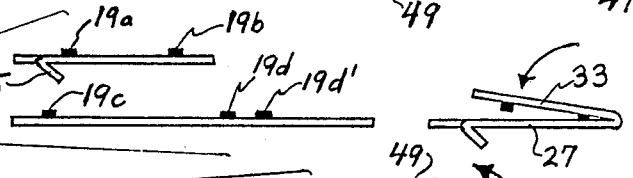

In the sequence illustrated, the ribbon 37 is then displaced toward the center of the web so that it overlies the left hand portion of the center ribbon 39 as illustrated in FIG. 2C. The center ribbon 39 provides a pair of basepieces 51, 53, between which the multiple pop-up assembly is eventually located in the ultimate product, with the basepieces serving as the front and rear covers of the promotional piece 15. At about the same time, a further folding operation is effected of the right hand ribbon 41 along the dotted line 55 which places the front pop-up panel 33 atop the intermediate pop-up panel 27 as depicted in FIG. 2C. As a result of this folding, the panels 27 and 33 become joined to each other along the long glue line **19*e*, and there is also adhesive interconnection between the tab 29 and a region near the upper edge of the front pop-up panel 33 via the short glue line 19*f***.

Figure 2D:
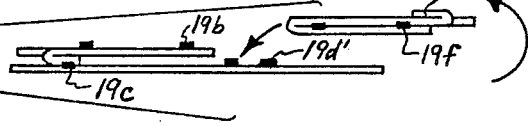

As depicted in FIG. 2D, the left hand ribbon 37 is lowered onto the central ribbon along the left hand edge thereof so there is contact between the glue line **19*c* and the underfolded connector subpanel 45 which creates a line of attachment therebetween. At about the same time, the right hand ribbon 41 is rotated 180° and then placed down on the right hand half of the central ribbon 39 in juxtaposition with the left hand ribbon 37 which has also been superimposed thereon. This contact between the right hand ribbon 41 and the central ribbon 39 effects attachment, along the glue lines 19*d* and 19*d*', between the basepiece 53 and the front pop-up panel 33. The line of attachment 19*d*' effectively divides the front panel into the main pop-up 33 and a base subpanel 33*a* which remains in contact with the basepiece 53 in the ultimate promotional piece 15, as best seen in FIG. 3**.

Figure 2E:
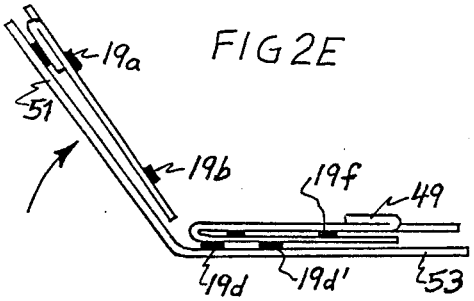
Figure 2F:
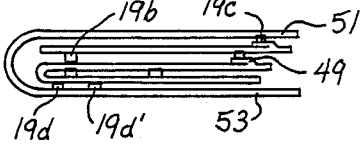

The final folding operation is illustrated in FIG. 2E where the central ribbon 39 is folded generally in half along the dotted line 59 shown in FIG. 1 so that the previously folded right hand and left hand ribbons are now sandwiched between the folded central ribbon 39 as depicted in FIG. 2F. As a result of the final folding step, adhesive bonds are created by the glue lines **19*a* and 19*b*. The glue line 19*b* connects to the rear surface of a lower portion of the intermediate panel 27 thus creating a short base section 23*a* (FIG. 3) as a subpanel of the rear pop-up 23. At the same time, the glue line 19*a* creates a line of attachment between the front surface of the rear pop-up panel 23 and the rear surface of the connector panel 49 that is hinged to the intermediate pop-up 27. If desired, the completely folded continuous web is then passed through compression rolls or the like to assure a strong adhesive joinder is obtained. Thereafter, the web 11 is severed transversely to separate the continuous web into a plurality of identical, flat-folded, promotional pieces of identical construction. Either prior to or after the transverse severing, the right hand edge, as depicted in FIG. 2F, may be trimmed to assure that the ultimate piece 15** has a smooth edge which the recipient will grasp to open it.

As illustrated in FIG. 3, upon opening, the promotional piece 15 presents an attractive decorative display of three upstanding interconnected pop-ups. The base section **23*a* of the rear pop-up 23 is affixed by the glue line 19*b* the base section 27*a* of the intermediate pop-up 27, which is in turn fixed to the base section 33*a* of the front pop-up 33 by the glue line 19*3*. The base subpanel 33*a* is in turn affixed to the inner surface of the basepiece 53 along the glue line 19*d* and the glue line 19*d*'. Thus, when the basepieces 51 and 53 are opened along the hinge line 59, the base panels 23*a*, 27*a* and 33*a* move in unison with the basepiece 53. The adhesive attachment of the connector panel 45 to the basepiece 51 along the glue line 19*c* pulls the rear pop-up 23 into its stand-apart position. Because of the line of attachment between the front surface of the rear pop-up 23 and the connector panel 49, along the glue line 19*a*, the intermediate pop-up panel 27 is pulled into its stand-apart position, and the interconnection between the tab 29 and the rear surface of the front pop-up 33** pulls it into its stand-apart position. Thus, the invention provides a method for producing an attractive promotional or advertising piece or the like from a continuous web on a web printing press in a manner which is particularly efficient and allows the mass-production of a complicated, multiple-pop-up assembly in an extremely economical manner, using manipulative operations which have become quite reliable and reproducible in web press production.

Although FIGS. 2A through 2F illustrate the preferred method of handling the continuous web 11 to produce a plurality of identical promotional pieces 15, it should be understood that changes as would be obvious to one having the ordinary skill in this art may be made in the illustrated method. For example, following (or even prior to) the folding of the connector panel portion 49 of the right hand web under the main part of the ribbon, the main folding operation on this ribbon can be made by folding to the right so as to bring the intermediate pop-up panel 27 into superimposed position atop the front pop-up panel 33. Manipulation in this manner then allows the right hand ribbon to be merely displaced laterally into position over the central ribbon without having to be rotated 180°, as hereinbefore desired. If it should be desirable to have the piece open until the basepieces form about a 180° angle, rather than the 90° angle shown, this can be accomplished by increasing the length of the connector 45.

Figure 4:
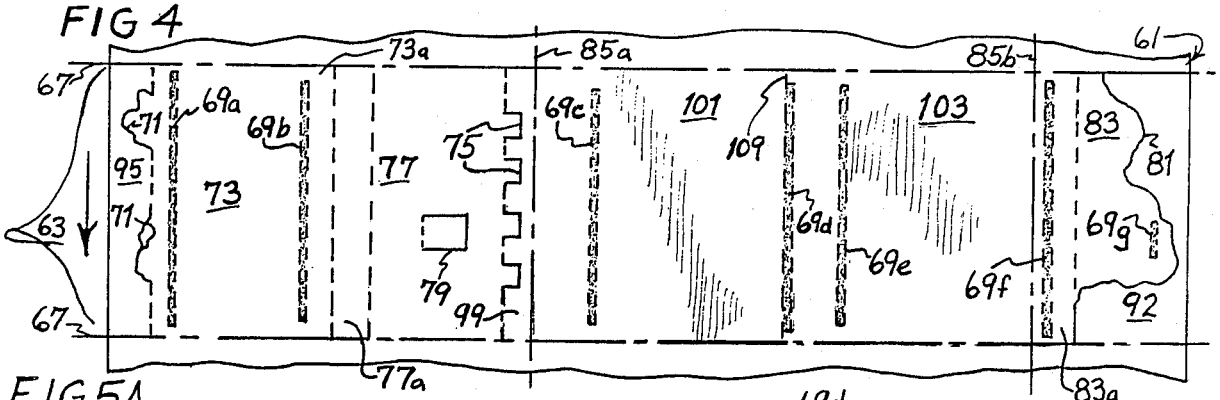
FIG. 4 is a view similar to FIG. 1 of an alternative embodiment of a continuous web that may be employed to produce a promotional piece substantially the same as that depicted in FIG. 3.

Depicted in FIG. 4 is an alternative embodiment of a blank for making a promotional piece which would have an appearance essentially the same as the promotional piece 15 illustrated in FIG. 3. Shown in FIG. 4 is a continuous web 61 wherein a single blank 63 is depicted as being demarcated between parallel dot-dash lines 67 along which the web will eventually be transversely severed. The region of the blank 63 of the continuous web has been die-cut, and a plurality of lines of adhesive 69 have been applied. Two die-cuts 71 define a portion of the upper edge of a rear pop-up panel 73, and a plurality of die-cuts 75 define a portion of the upper edge of an intermediate pop-up 77 wherein a tab 79 is also die-cut. A final die-cut 81 extends for the length of the blank 63 and defines the entire upper edge of the front pop-up panel 83.

The web 61 is again slit into three continuous ribbons along parallel lines 85*a* and 85*b* creating a left hand ribbon 87, a central ribbon 89 and a right hand ribbon 91. In this configuration, the left hand ribbon 87 contains both the rear pop-up panel 73 and the intermediate pop-up panel 77. The central ribbon 89 again includes the pair of basepieces; however, the right hand ribbon includes only the front pop-up panel 83.

Following the slitting step, both lateral edges of the left hand ribbon 87 are folded, with the left hand edge, which constitutes the connector panel 95, being folded under the ribbon 87 and the right hand edge, which constitutes the connector panel 99, being folded over the ribbon. At about the same time, the scrap 92 from the die-cutting is separated from the pop-up panel portion of the right hand ribbon 91, and the ribbon is displaced onto the desired location on the right hand portion of the central ribbon 89 which ribbon will constitute a pair of basepieces 101, 103. The glue line 69*e* on the portion of the central ribbon which constitutes the right hand basepiece 103 is located where it will create a line of demarcation on the superimposed front pop-up panel which divides the panel into a base subpanel 83*a*.

Next, the left hand ribbon 87 with its folded edges is moved laterally and superimposed atop the subassembly of the central ribbon and the right hand ribbon, resulting in the creation of interconnections between the connector 95 and the basepiece 101 along the glue line 69*c*, between the base subpanel 77*a* of the intermediate pop-up panel 77 and the basepiece 103 at a location next to the fold line 109 by means of the glue line 69*d*, and between the intermediate pop-up panel 77 and the base portion 83*a* of the front pop-up panel along the glue line 69*f*. In addition, the die-cut tab 79 becomes adhesively affixed to the rear surface of the front pop-up 83 via the short glue line 69*g*.

Figure 5A:
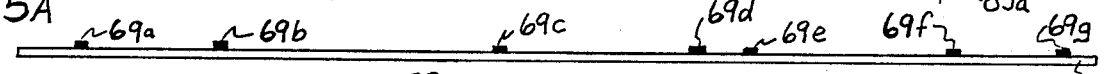
FIGS. 5A–5E are a series of diagrammatic views similar to FIGS. 2A–2F showing one method of handling the continuous web depicted in FIG. 4 to produce promotional pieces, with FIG. 5E being enlarged in size.
Figure 5B:
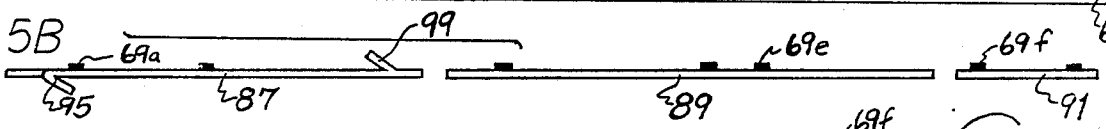
Figure 5C:
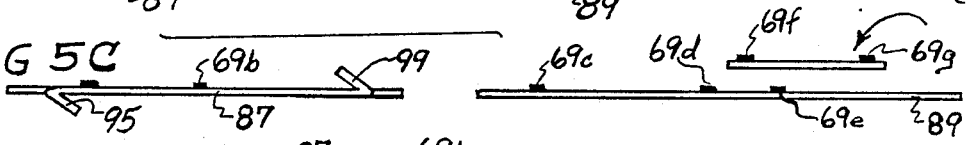
Figure 5D:
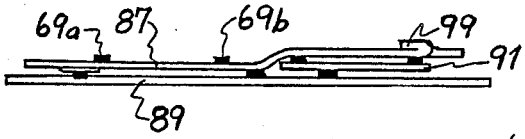
Figure 5E:
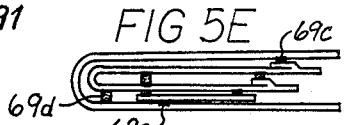

The final step constitutes folding of the central ribbon 89, from the orientation shown in FIG. 5D, along the center line 109 of the basepieces to sandwich the three pop-up panels therebetween and ultimately reach the flat-folded web shown in FIG. 5E (which is enlarged in size). As a result of this final folding step, further attachments are made along the glue lines 69*a* and 69*b*, and a compression step is then preferably applied to assure strong adhesive attachment is achieved along all of the glue lines. Thereafter, trimming and transverse severing of the web is effected, as described hereinbefore, to produce the plurality of identical promotional pieces.

Figure 6:
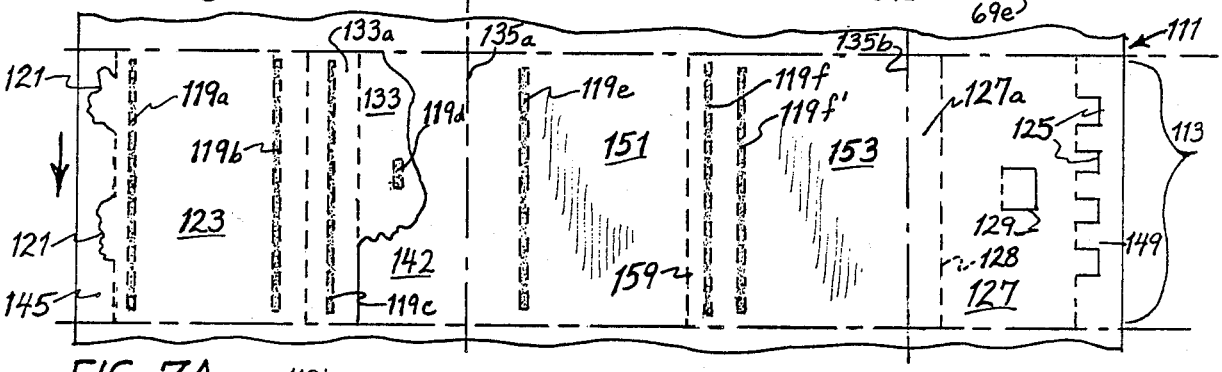
FIG. 6 is a view similar to FIG. 1 of another alternative embodiment of a continuous web that may be employed to produce a promotional piece substantially the same as that depicted in FIG. 3.

Depicted in FIG. 6 is another alternative embodiment of a blank for making a promotional piece which would have an appearance essentially the same as the promotional piece 15 illustrated in FIG. 3. Shown in FIG. 6 is a continuous web 111 wherein a single blank 113 is depicted as being demarcated between parallel dot-dash lines 117 along which the web will eventually be transversely severed. The region of the blank 113 of the continuous web has been die-cut, and a plurality of adhesive lines 119 have been applied. A die-cut 121 defines a portion of the upper edge of a rear pop-up panel 123, and a plurality of die-cuts 125 define a portion of the upper edge of an intermediate pop-up 127 wherein a tab 129 is also die-cut. A final die-cut 131 extends for the length of the blank 113 and defines the entire upper edge of the front pop-up panel 133.

Figure 7A:
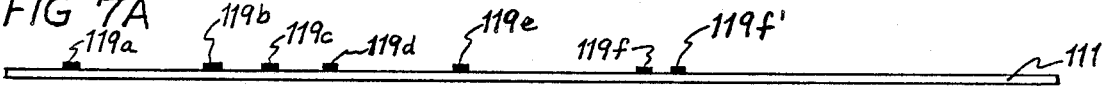
FIGS. 7A–7E are a series of diagrammatic views similar to FIGS. 2A–2F showing one method of handling the continuous web depicted in FIG. 6 to produce promotional pieces with FIGS. 7D and 7E being enlarged in size.
Figure 7B:
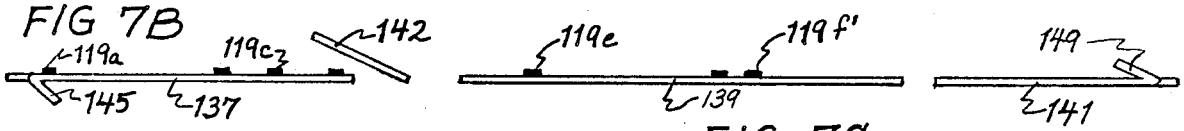

The web 111 is again slit into three continuous ribbons along parallel lines 135*a* and 135*b* creating a left hand ribbon 137, a central ribbon 139 and a right hand ribbon 141, shown in FIG. 7B. In this configuration, the left hand ribbon 137 contains both the rear pop-up panel 123 and the front pop-up panel 133. The central ribbon 139 again includes the pair of basepieces 151, 153; however the right hand ribbon includes only the intermediate pop-up panel 127.

Following the slitting step, the left hand lateral edge of the left hand ribbon 137 is folded so that the connector panel 145 is folded under the ribbon 137. At about the same time, the scrap 142 from the die-cutting is separated from the right hand edge of the ribbon 137, and the ribbon is then displaced onto the desired location upon the central ribbon 139 atop both basepieces 151, 153, as shown in FIG. 7C. The glue lines 119*f* and 119*f'* secure the undersurface of the front pop-up panel 133 to the portion of the central ribbon which constitutes the right hand basepiece 153, and the glue line 119*f'* is located to create a line of demarcation which divides the panel 133 into a base subpanel 133*a*. The glue line 119*e* interconnects the connector 145 to the basepiece 151. Next, the right hand ribbon 141 with its right hand edge portion, constituting the connector panel 149 that has been folded atop the ribbon, is moved laterally and superimposed atop the subassembly of the central ribbon and the left hand ribbon, as shown in FIG. 7D (which is enlarged in size), resulting in interconnections between the subpanel base 127*a* of the intermediate pop-up panel 127 and the base subpanel 133*a* along the glue line 119*c* which creates the line of demarcation 128, and between the die-cut tab 129 and the rear surface of the front pop-up 133 via the short glue line 119*d*.

Figure 7D:
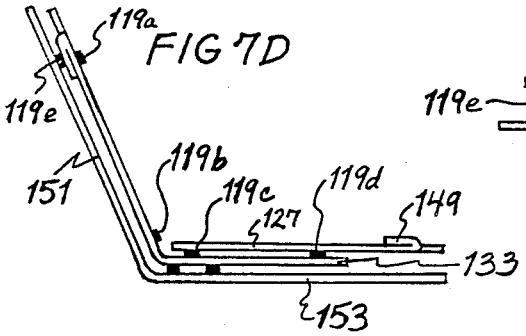
Figure 7C:
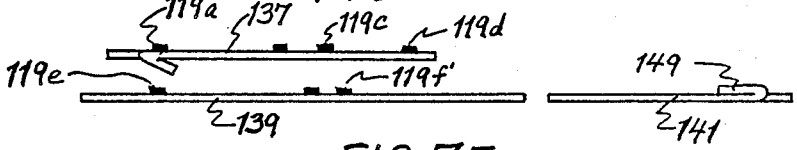
Figure 7E:
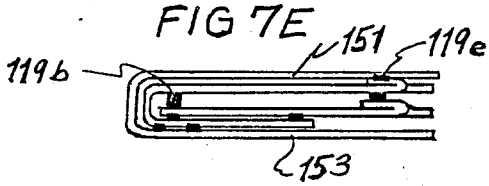

The final step constitutes folding of the central ribbon 139 along its center line 159 between the basepieces 151 and 153 to sandwich the three pop-up panels therebetween, as generally shown in FIG. 7D, to ultimately reach the flat-folded web shown in FIG. 7E. As a result of this final folding step, two further attachments are made along the glue lines 119*a* and 119*b*, and a compression step is then preferably applied to assure strong adhesive attachment is achieved along all of the glue lines. Thereafter, trimming and transverse severing of the web is effected as described hereinbefore to produce the plurality of identical promotional pieces.

Depicted in FIG. 8 is still another alternative embodiment of a blank for making a promotional piece which would have an appearance essentially the same as the promotional piece 15 illustrated in FIG. 3. Shown in FIG. 8 is a continuous web 161 wherein a single blank 163 is depicted as being demarcated between parallel dot-dash lines 167 along which the web will eventually be transversely severed. The region of the blank 163 of the continuous web has been die-cut, and a plurality of lines of adhesive 169 have been applied. Two die-cuts 171 define a portion of the upper edge of a rear pop-up panel 173, and a plurality of die-cuts 175 define a portion of the upper edge of an intermediate pop-up 177 wherein a tab 179 is also die-cut. A final die-cut 181 extends for the length of the blank 163 and defines the entire upper edge of the front pop-up panel 183.

The web 161 is slit into two continuous ribbons along line 185 creating a main ribbon 189 and a narrow right hand ribbon 191, as shown in FIG. 9B. In this configuration, the main ribbon 189 contains both the rear pop-up panel 173 and the front pop-up panel 183 in flanking relationship to a pair of basepieces 201, 203. The right hand ribbon includes only the intermediate pop-up panel 177.

Following the slitting step, a connector panel 195 at the right hand lateral edge of the main ribbon 189 is folded over the ribbon, and the scrap 192 is removed from the vicinity of the left hand edge. The connector panel 199 is folded under the narrow ribbon 191. Next, as shown in FIG. 9C, the front pop-up panel 183 is folded about line 184 onto the left hand basepiece 201, and the rear pop-up panel 173 is folded about line 186 onto the right hand portion of the main ribbon 189 which constitutes the basepiece 203. The glue line 169*b* on the portion of the main ribbon which constitutes the left hand basepiece 201 is located where it will create a line of demarcation on the superimposed front pop-up panel which divides the panel 183 into a base subpanel 183*a*. The glue line 169*a* adjacent fold line 184 and the glue line 169*d* adjacent fold line 186 attach the facing panels near the lateral edges of the partially folded assembly and assist in creating a false backbone. The connector 195 becomes attached to the basepiece 203 along the glue line 169*c*.

At this point, additional glue lines 169*h* and 169*i* are laid down along the lateral edges of the partially folded main ribbon 189, as shown in FIG. 9D, together with glue line 169*j*. Next, the right hand ribbon 191 with its folded edge is moved laterally and superimposed atop the right hand portion of partially folded main ribbon, resulting in the creation of interconnections between the base subpanel 177*a* of the intermediate pop-up panel 177 and the subpanel 173*a* of the rear pop-up by means of the glue lines 169*i* and 169*j*, and between the hinged connector 199 of the intermediate pop-up panel and the front surface of the rear pop-up panel 173 along the glue line 169*e*, as also depicted in FIG. 9D. If desired, the die-cutting and printing of the narrow ribbon could be reversed so that the hinged connector 199 is located along the right hand edge of the ribbon instead of along its left hand edge as shown; in such an instance, it would then be further laterally displaced and located atop the left hand portion of the partially folded main ribbon.

The final step constitutes folding of the main ribbon 189, from the orientation shown in FIG. 9D, along the center line 209 of the basepieces to sandwich the three pop-up panels therebetween and ultimately reach the flat-folded web shown in FIG. 9E. As a result of this final folding step, further attachments are made along the glue lines 169*g* and 169*h*, between the subpanel bases 183*a* and 177*a* of the front and intermediate pop-ups. In addition, the die-cut tab 179 becomes adhesively affixed to the rear surface of the front pop-up 183 via the short glue line 169*f*. A compression step is then preferably applied to assure strong adhesive attachment is achieved along all of the glue lines. Thereafter, trimming of both edges as depicted in FIG. 9E eliminates the fold line 209, and transverse severing of the web is effected as described hereinbefore to produce the plurality of identical promotional pieces, resembling that shown in FIG. 3 except for the false backbone.

Depicted in FIG. 10 is yet another alternative embodiment of a blank for making a promotional piece which would have an appearance essentially the same as the promotional piece 15 illustrated in FIG. 3. Shown in FIG. 10 is a continuous web 261 wherein a single blank 263 is depicted as being demarcated between parallel dot-dash lines 267 along which the web will eventually be transversely severed. The region of the blank 263 of the continuous web has been die-cut, and a plurality of lines of adhesive 269 have been applied. Two die-cuts 271 define a portion of the upper edge of a rear pop-up panel 273, and a plurality of die-cuts 275 define a portion of the upper edge of an intermediate pop-up 277 wherein a tab 279 is also die-cut. A final die-cut 281 extends for the length of the blank 263 and defines the entire upper edge of the front pop-up panel 283.

The web 261 is slit into two continuous ribbons along line 285 creating a main ribbon 289 and a narrow right hand ribbon 291. In this configuration, the main ribbon 289 contains both the rear pop-up panel 273 and the intermediate pop-up panel 277 in flanking relationship to the pair of basepieces 301, 303. The right hand ribbon includes only the front pop-up panel 283.

Following the slitting step, the connector panel 295 at the left hand lateral edge of the main ribbon 289 is folded over the ribbon, and the connector panel 299 is folded under the right hand edge of the ribbon 289. The scrap 292 is removed from the right hand ribbon. Next, the right hand ribbon 291 is moved laterally, rotated 180° and superimposed atop the right hand basepiece 303 of the main ribbon, resulting in the creation of interconnections between the base subpanel 283*a* of the front pop-up panel 283 and the right hand basepiece 303 by means of the glue lines 269*c* and 269*h*.

The rear pop-up panel 273 is folded about line 284 onto the left hand basepiece 301, and the intermediate pop-up panel 277 is folded about line 286 onto the subassembly of the front pop-up panel 283 and the basepiece 303. The glue line 269a on the main ribbon near the left hand edge of basepiece 301 is located where it will create part of the false backbone. The glue line 269b attaches the connector 295 to the basepiece 301. The glue line 269d adjacent fold line 286 attaches the facing pop-up panels at their edges and also assists in creating the false backbone, and the adjacent glue line 269e is located to create a line of demarcation on the intermediate pop-up panel which divides the panel 277 into a base subpanel 277a which is joined to the base subpanel 283a. The tab 279 becomes attached to the front pop-up along the short glue line 269f.

At this point, two additional glue lines 269i and 269j are laid down along the left hand lateral edge of the partially folded main ribbon 289 and spaced slightly inward, as shown in FIG. 11D.

The final step constitutes folding of the main ribbon 289, from the orientation shown in FIG. 11E, along the center line 309 of the basepieces to sandwich the three pop-up panels therebetween and ultimately reach the flat-folded web shown in FIG. 11F. As a result of this final folding step, further attachments are made along the glue line 269i between the lateral edges, along the glue line 269j between the subpanels 273a and 277a, and along the glue line 269g between the connector 299 of the intermediate pop-up and the rear pop-up 273. A compression step is then preferably applied to assure strong adhesive attachment is achieved along all of the glue lines. Thereafter, trimming of both edges, as depicted in FIG. 11F, eliminates the fold line 309, and transverse severing of the web is effected as described hereinbefore to produce the plurality of identical promotional pieces, resembling that shown in FIG. 3 except for the false backbone.

Although the foregoing constitutes the best mode contemplated by the inventor for carrying out this fabrication method, it should be understood that various changes and adaptations as would be obvious to one having the ordinary skill in the art may be made without departing from the scope of the invention which is defined by the claims which are appended hereto. For example, as an optional alternative to providing the connector subpanel 49, the entire upper edge of the intermediate pop-up panel could be die-cut, with the strip therebetween and the line of slitting 35b being removed as scrap, in which instance, one or more die-cut tabs could be formed in the rear pop-up panel 23 which would carry short glue lines equivalent to the glue line 19a so the intermediate pop-up panel would then be pulled into its stand-apart position by the interconnection with the one or more die-cut tabs, in a manner similar to the interconnection between the tab 29 and the rear surface of the front pop-up panel 33. In such an instance, a segmented glue line 19a would be preferably applied to the portion of the web which would constitute the die-cut tabs, and it should be understood that the glue line 19f could likewise be applied to the die-cut tab 29, if desired. In similar fashion, a die-cut tab in the basepiece could be used instead of the connector 45 to engage the rear pop-up panel eliminating the folding of any of the pop-up panels, until, of course, the recipient opens the piece. In addition, certain of the steps described can be performed in different sequences while accomplishing the same end result. Moreover, instead of slitting the web longitudinally to form a plurality of ribbons, it would be possible to simultaneously print and die-cut two separate webs of appropriate width or even pre-print and die-cut one web; such an alternative procedure might be used if the overall piece required a total width wider than the standard web width or required a different sheet material for certain of the panels. Particular features of the invention are emphasized in the claims which follow.

What is claimed is:

1. A method of making a promotional piece having multiple interconnected pop-ups, which method comprises die-cutting a continuous web of printed sheet material to create a series of successive blanks each of which includes a plurality of pop-up panels associated with a pair of basepieces and is arranged to extend transversely across the width of said web, applying a plurality of glue lines to each of said blanks of said web, cutting said web longitudinally into at least three continuous ribbons, a first ribbon containing a first pop-up panel, a second ribbon containing a second pop-up panel, and a third ribbon containing said basepieces, folding said first ribbon upon itself along a line extending longitudinally of said web, locating said folded first ribbon and said second ribbon in superimposed positions upon said third ribbon so that there is attachment of at least one of said pop-up panels to at least one of said basepieces via at least one of said glue lines, folding said third ribbon upon itself along a line extending longitudinally of said web so as to sandwich said first and second ribbons therebetween with adjacent ribbons interconnected to each other by said glue lines, and transversely cutting said continuous web to form a plurality of identical promotional pieces having interconnected pop-ups.

2. A method in accordance with claim 1 wherein said folding of said first ribbon places said first pop-up panel in face-to-face contact with a first hinged connector and wherein said locating step places said first hinged connector between said first pop-up panel and one of said basepieces to which it is attached via one of said glue lines.

3. A method in accordance with claim 2 wherein said first ribbon contains a third pop-up panel along with said first pop-up panel, and wherein said locating step initially places said second pop-up panel upon one of said basepieces and then places said first ribbon upon said third ribbon in a way that said first and third pop-up panels are superimposed, respectively, upon each of said basepieces.

4. A method in accordance with claim 3 wherein said folding of said first ribbon places said third pop-up panel in face-to-face contact with a connector hinged thereto and wherein said locating step places said third pop-up panel between said connector which is hinged thereto and said second pop-up panel.

5. A method in accordance with claim 3 wherein tab means is die-cut in said third pop-up panel and wherein said tab means becomes attached to said second pop-up panel via one of said glue lines as a result of said folding of said third ribbon.

6. A method in accordance with claim 2 wherein said first ribbon contains a third pop-up panel along with said first pop-up panel, and wherein said locating step initially places said first ribbon upon said basepieces and then places said second ribbon upon said first ribbon.

7. A method of making a promotional piece having multiple interconnected pop-ups, which method comprises die-cutting a continuous web of printed sheet material to create a series of successive blanks each of which includes a plurality of pop-up panels associated with first and second basepieces and is arranged to extend transversely across the width of said web, applying a plurality of glue lines to each of said blanks of said web, cutting said web longitudinally into at least two continuous ribbons containing three pop-up panels and said basepieces, folding at least one of said ribbons upon itself along a line extending longitudinally of said web, locating said folded ribbon in association with the other ribbon with said pop-up panels in superimposed positions upon said basepieces so that there is attachment of at least one of said pop-up panels to each of said basepieces via said glue lines, folding said superimposed ribbon assembly upon itself along a line extending longitudinally of said web so as to sandwich said pop-up panels between said basepieces and interconnect adjacent pop-up panels to each other by at least one of said glue lines, and transversely cutting said continuous web to form a plurality of identical promotional pieces having interconnected pop-ups.

8. A method in accordance with claim 7 wherein a narrow ribbon containing an intermediate pop-up panel is cut from the remaining main ribbon which contains said basepieces flanked respectively by a rear pop-up panel and a front pop-up panel, and wherein said folding places a first hinged connector in face-to-face contact with said rear pop-up panel and places said front pop-up panel in face-to-face contact with said first basepiece to which it is hinged.

9. A method in accordance with claim 8 wherein said rear pop-up panel is folded atop said second basepiece to which it is hinged so that said first hinged connector becomes attached to said second basepiece.

10. A method in accordance with claim 9 wherein said narrow ribbon is folded so as to fold a second hinged connector onto said intermediate pop-up panel and is then located in superimposed position atop said folded main ribbon so that there is attachment of said folded narrow ribbon to one of said other pop-up panels.

11. A method in accordance with claim 10 wherein a glue line is applied along one of the lateral edges of said folded main ribbon so that the free lateral edges of said folded assembly become joined to form a false backbone and wherein the opposite edge of said folded assembly is trimmed.

12. A method in accordance with claim 7 wherein a narrow ribbon containing a first pop-up panel is cut from the remaining main ribbon which contains said basepieces flanked respectively by a second pop-up panel and a third pop-up panel, and wherein said folding places a first hinged connector in face-to-face contact with said second pop-up panel and places said third pop-up panel in face-to-face contact with said first basepiece to which it is hinged.

13. A method in accordance with claim 12 wherein said narrow ribbon is located in superimposed position atop said main ribbon so that there is attachment of said narrow ribbon to said second basepiece.

14. A method in accordance with claim 13 wherein said second pop-up panel is folded atop said narrow ribbon and said second basepiece to which it is hinged so that said second pop-up panel becomes attached to said first pop-up panel.

15. A method in accordance with claim 14 wherein a glue line is applied along one of the lateral edges of said folded main ribbon so that the free lateral edges of said completely folded assembly become joined to form a false backbone and wherein the opposite edge of said completely folded assembly is trimmed.

16. A method of making a promotional piece having multiple interconnected pop-ups, which method comprises die-cutting a continuous web of printed sheet material to create a series of successive blanks each of which includes a plurality of pop-up panels associated with a pair of basepieces and is arranged to extend transversely across the width of said web, applying a plurality of glue lines to each of said blanks of said web, cutting said web longitudinally into at least three ribbons, a first ribbon containing a first pop-up panel and a first hinged connector, a second ribbon containing a second pop-up panel and a second hinged connector, and a third ribbon containing said basepieces, folding said first ribbon upon itself to place said first pop-up panel in face-to-face contact with said first hinged connector, folding said second ribbon to place one surface of said second pop-up panel in face-to-face contact with said second hinged connector, locating said folded first ribbon and said folded second ribbon in superimposed positions upon said third ribbon so that said first hinged connector lies between said first pop-up panel and one of said basepieces, said second pop-up panel lies between said second hinged connector and the other of said basepieces, and there is at least attachment of said first hinged connector to said one basepiece via at least one of said glue lines, folding said third ribbon upon itself so as to sandwich said first and second ribbons therebetween and cause said second connector to become interconnected to said first pop-up panel by one of said glue lines, and transversely cutting said continuous web to form a plurality of identical promotional pieces having interconnected pop-ups.

17. A method in accordance with claim 16 wherein said second ribbon contains a third pop-up panel along with said second pop-up panel, wherein said folding of said second ribbon upon itself brings said third pop-up panel into contact with the opposite surface of said second pop-up panel and wherein said locating step positions said third pop-up panel between said second pop-up panel and the other of said pair of basepieces.

18. A method in accordance with claim 17 wherein tab means is die-cut in said second pop-up panel and wherein said tab means becomes attached to said third pop-up panel via one of said glue lines.

* * * * *